United States Patent [19]

True et al.

[11] Patent Number: 4,630,688

[45] Date of Patent: Dec. 23, 1986

[54] POWER SPINNER FOR ROTATING A KELLY JOINT

[75] Inventors: Martin E. True; Clarence W. Sullivan, both of Houston, Tex.

[73] Assignee: Weatherford/Lamb, Inc., Houston, Tex.

[21] Appl. No.: 278,438

[22] Filed: Jun. 24, 1981

[51] Int. Cl.[4] ..... E21B 3/00

[52] U.S. Cl. ..... 173/163; 166/78; 175/170; 74/8; 74/337.5

[58] Field of Search ..... 173/57, 163; 166/78; 175/170; 74/8, 384, 337.5

[56] References Cited

U.S. PATENT DOCUMENTS

| | | | |
|---|---|---|---|
| 1,262,666 | 4/1918 | Heinze | 74/8 X |
| 1,997,571 | 4/1935 | Billon et al. | 74/8 |
| 2,025,877 | 12/1935 | Maurer | 74/8 |
| 3,144,085 | 8/1964 | Hasha . | |
| 3,212,578 | 10/1965 | Hasha . | |
| 3,390,728 | 7/1968 | Bartos | 173/163 |
| 3,690,189 | 9/1972 | Webb | 74/8 |
| 4,221,269 | 9/1980 | Hudson | 173/163 |

FOREIGN PATENT DOCUMENTS

| | | | |
|---|---|---|---|
| 467160 | 6/1914 | France | 74/8 |

*Primary Examiner*—Robert P. Olszewski

*Attorney, Agent, or Firm*—Fulbright & Jaworski

[57] ABSTRACT

An improved power spinner for rotating a kelly joint having a pipe sub rotatably mounted in a housing with a ring gear on the sub and a motor mounted on the housing for powering the ring gear. A drive gear is connected coaxially to the motor and a shifting arm is pivotally mounted coaxially with the axis of the drive gear. A movable gear is positioned in the plane of the ring gear and mounted on the shifting arm for engagement and disengagement with the ring gear and the movable gear is connected to and driven by the drive gear and rotatable about the drive gear. A control is connected to the shifting arm for laterally moving the movable gear toward and away from the ring gear and for locking the gears together when engaged. The control may include a cam engaging the arm for rotating the arm about the axis of the drive gear with a bell crank connected to the arm and an actuator connected to the bell crank. A control insures that the movable gear is in engagement with the ring gear before the motor is actuated.

4 Claims, 9 Drawing Figures

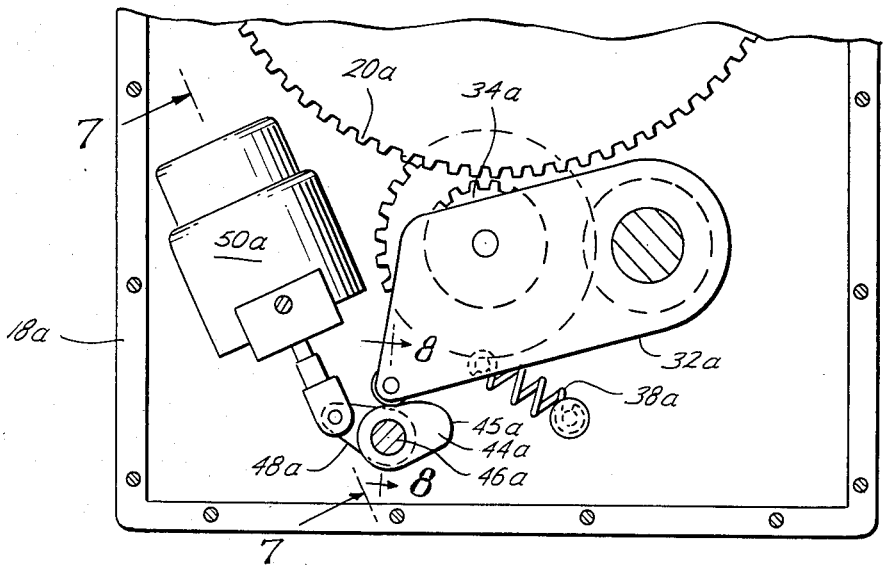
Fig. 6
Fig. 7
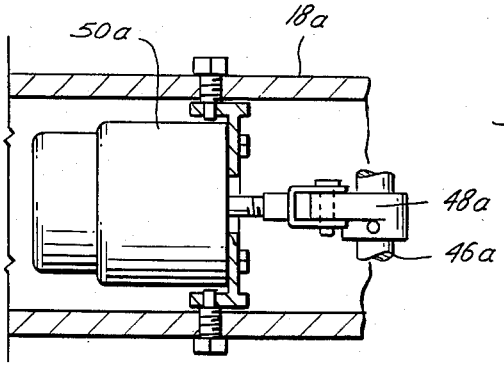
Fig. 8
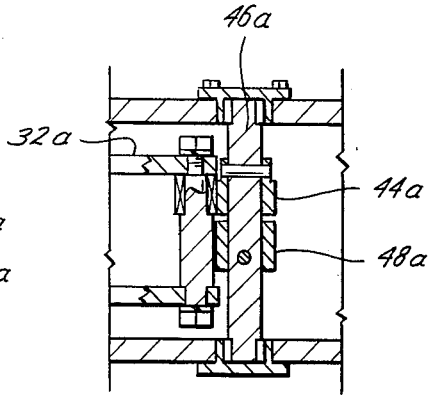

POWER SPINNER FOR ROTATING A KELLY JOINT

BACKGROUND OF THE INVENTION

Drilling rigs used in drilling oil and gas wells employ a kelly joint that may be either square or hexagonal in cross section. The kelly joint is connected to a drill string on the lower end and is connected to a fluid swivel joint at the upper end. The kelly joint is provided with a drive bushing that connects through a rotary table at the derrick floor level and can move vertically through the drive bushing to impart rotation to the drill string. It is old as indicated in U.S. Pat. Nos. 3,144,085 and 3,212,578 to provide a power spinner for rotating the kelly joint for connecting and disconnecting the kelly joint from the drill string.

The present invention is directed to an improved power spinner including moving the actuating gears laterally toward and away from each other for providing a strong driving action yet one which avoids clashing of gears.

SUMMARY

The present invention is directed to a power spinner for rotating a kelly joint having a pipe sub rotatably mounted in a housing with a ring gear on the sub and a motor mounted on the housing for powering the ring gear having an improved movable gear driven by the motor and mounted for movement in the plane of the ring gear for engagement and disengagement with the ring gear. Control means are connected to the movable gear for laterally moving the movable gear toward and away from the ring gear.

A still further object of the present invention is the provision of a drive gear connected coaxially to the motor and a shifting arm pivotally mounted coaxially with the axis of the drive gear. The movable gear is mounted on the shifting arm and connected to and driven by the drive gear and is rotatable about the drive gear.

A further object of the present invention is the provision of a cam engaging the shifting arm for rotating the arm about the axis of the drive gear. The cam may be actuated by a bell crank connected to actuating means which may be either hydraulic or pneumatic.

Still a further object of the present invention is the provision of a control means for laterally moving the shifting arm and movable gear toward and away from the ring gear, locking the mating gears together when engaged, and insuring that the movable gear engages the ring gear prior to the actuation of the motor.

Other and further objects, features and advantages will be apparent from the following description of presently preferred embodiments of the invention, given for the purpose of disclosure, and taken in conjunction with the accompanying drawings.

BRIEF DESCRIPTION OF THE DRAWINGS

FIG. 6 is a fragmentary elevational view of a further embodiment of the present invention, FIG. 7 is a cross-sectional view taken along the lines 7—7 of FIG. 6, FIG. 8 is a cross-sectional view taken along the lines 8—8 of FIG. 6.

DESCRIPTION OF THE PREFERRED EMBODIMENTS

Figure 3:
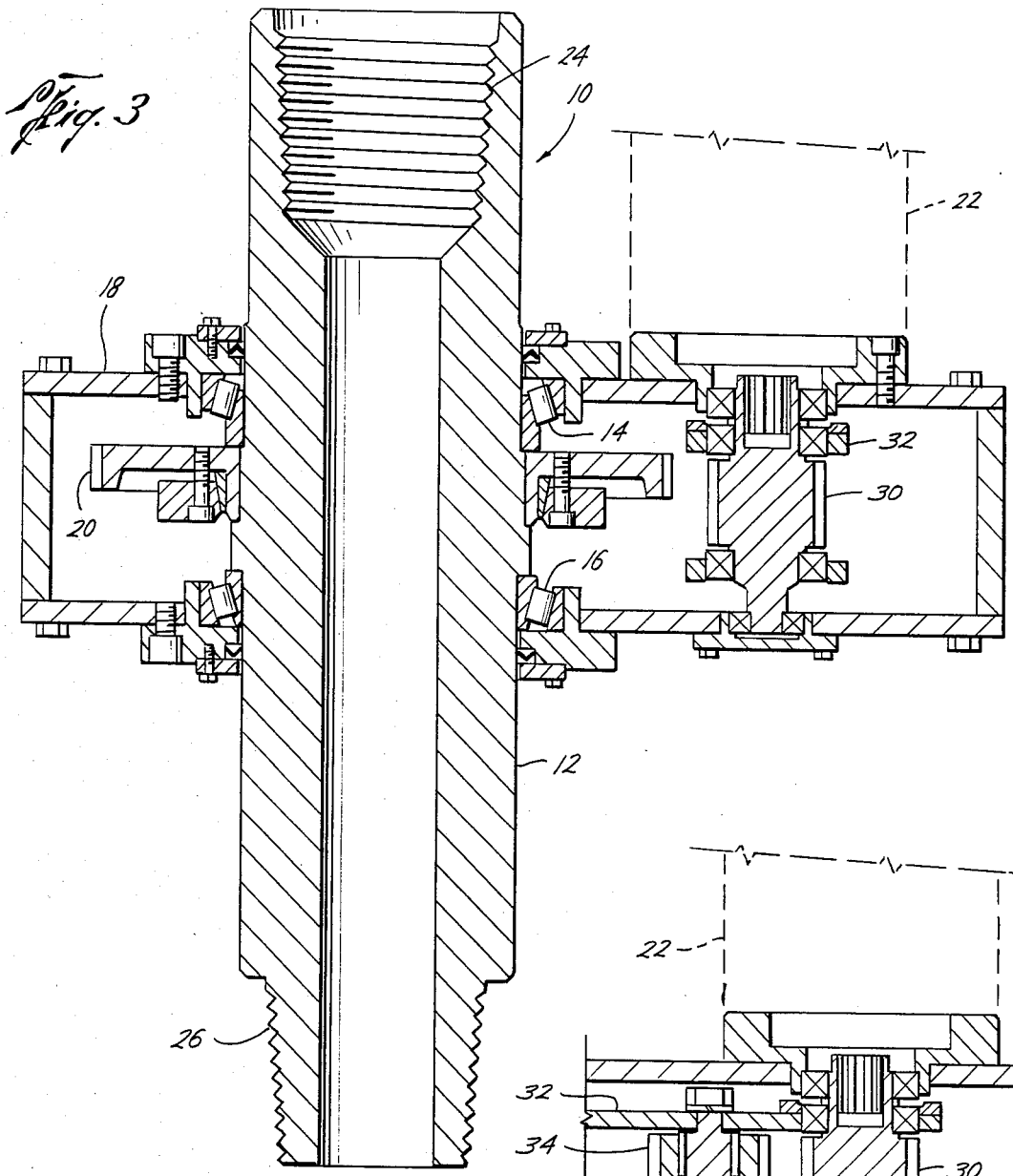
FIG. 3 is a cross-sectional view along the line 3—of FIG. 1.
Figure 4:
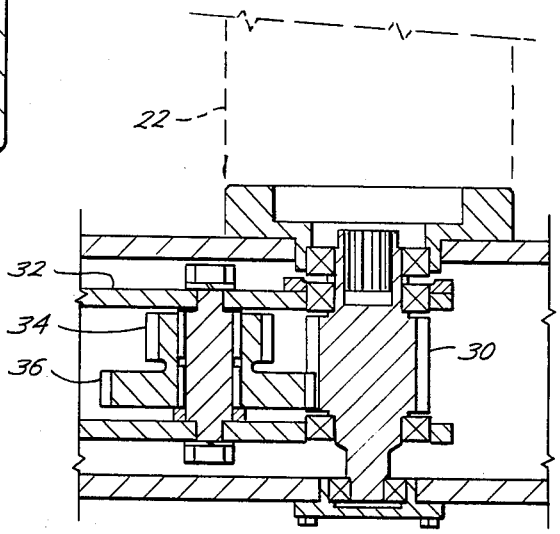
FIG. 4 is a cross-sectional view taken along the line 4—4 of FIG. 1.

Referring now to the drawings, and particularly to FIG. 3, the reference numberal 10 generally indicates the power spinner of the present invention and generally includes a pipe sub 12 rotatably mounted on bearings 14 and 16 in a housing 18, with a ring gear 20 connected to the sub 12, and a suitable motor 22, which may be hydraulic, air, or electric for powering the ring gear 20. The upper end of the sub 12 includes connecting means such as threads 24 for connection to a rotary swivel and the lower end of the sub 12 includes connecting means such as threads 26 for connection to the upper end of a kelly joint.

The above description of a power spinner is generally old, but the present invention is directed to an improved mechanism for connecting and disconnecting the motor 22 to and from the ring gear 20. Referring now to FIGS. 1-4, a drive gear 30 is positioned coaxially with and connected to the motor 22, and a shifting arm 32 is pivotally mounted coaxially with the axis of the drive gear 30 and carries a movable gear 34. The movable gear 34 is positioned in the plane of the ring gear 20 and movement of the shifting arm 32 will move the movable gear 34 into and out of engagement with the ring gear 20. Thus the movable gear 34 moves circularly about the axis of the drive gear 30. While the movable gear 34 may be connected directly to the drive gear 30, it is preferable to provide an intermediate gear 36 in engagement with the driven gear 30 and connected to the movable gear 34 for providing a change in speed and torque applied to the sub 12. It is to be particularly noted that the movable gear 34 moves laterally into engagement with the ring gear 20 with a circular motion for more easily meshing the mating gears.

Figure 1:
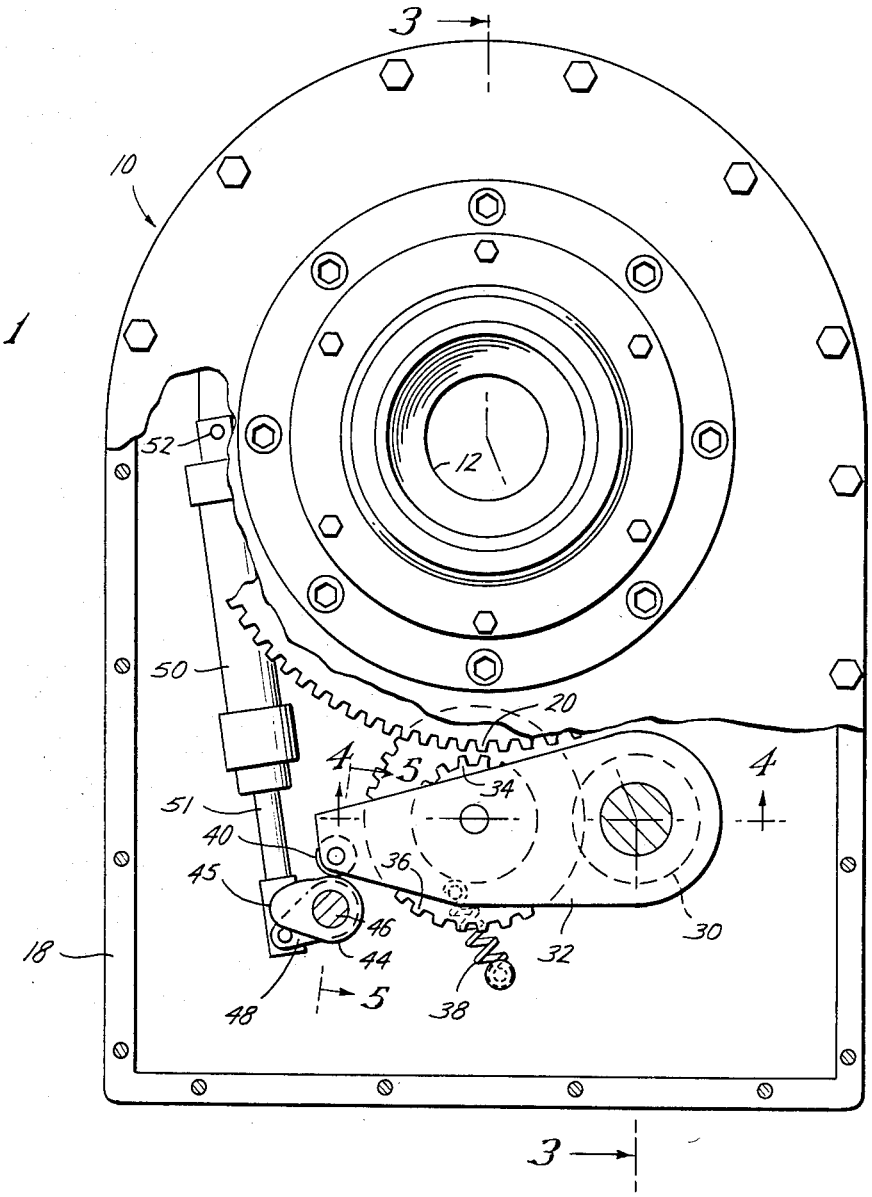
FIG. 1 is an elevational view, partly broken away, illustrating the preferred embodiment of the present invention in the non-engaging position.
Figure 2:
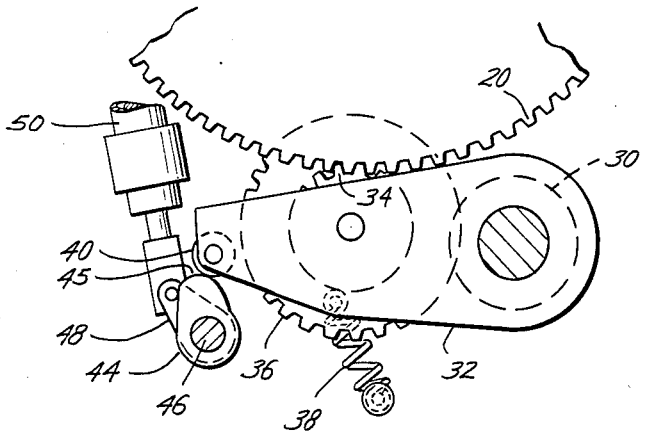
FIG. 2 is a fragmentary elevational view of the apparatus of FIG. 1 illustrating the apparatus in the engaged and locked position.

Suitable control means are provided for laterally moving the shifting arm 32 and thus laterally moving the movable gear 34 toward and away from the ring gear 20. Referring to FIGS. 1 and 2, a spring 38 is connected between the shifting arm 32 and the housing 18 for yieldably urging the arm 32 and movable gear 34 away from the ring gear 20.

Figure 5:
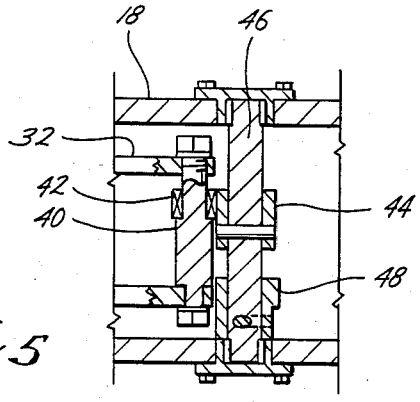
FIG. 5 is a cross-sectional view taken along the line 5—5 of FIG. 1.

Referring now to FIGS. 1, 2 and 5, the shifting arm 32 includes a shaft 40 having a bearing 42 which engages a cam 44 mounted on a shaft 46 in the housing 18. Rotation of the cam 44 against the bearing 42 causes movement of the shifting arm 32 and the movable gear 34 from the disengaged position of FIG. 1 to the engaged position of FIG. 2. Preferably the cam 44 is actuated by a bell crank having an arm 48 connected to the shaft 46. Suitable actuating means such as a hydraulic or pneumatic piston and cylinder assembly 50 is pivotally connected to the crank arm 48 for rotating the cam 44 for laterally moving the shifting arm 32 and movable gear 34 towards gear 20. The second end of the piston and cylinder assembly 50 is pivotally connected at 52 to the housing 18. Thus when the piston and cylinder assembly 50 is unpressured, the cam 44 is rotated by the spring 38 to retract the shifting arm 32 and movable gear 34. When assembly 50 is pressured, the assembly 50 retracts and rotates the cam 44 in a direction to move the shifting arm 32 and gear 34 and overcome the spring 38.

Another feature of the present invention includes suitable means for locking the gears 34 and 20 in a fully engaged position. Thus the cam 44 may include a constant radius section 45 at the end of travel which holds the gears 34 and 20 in engagement while the assembly 50 is powered. However, on deactuation of the assembly 50, the cam 44 is rotated to a release position by the action of spring 38.

A further embodiment of the present invention is shown in FIGS. 6, 7 and 8 which is similar to the embodiment of FIGS. 1–5 in which the actuator 50*a* is a pneumatic or hydraulic diaphragm which upon extension causes rotation of cam 44*a* to move the shifting arm 32*a* and gear 34*a* toward ring gear 20*a*. Release of power to the actuating unit 50*a* allows the spring 38*a* to rotate the cam 44*a* to retract the gear 34*a* from the gear 20*a*.

Figure 9:
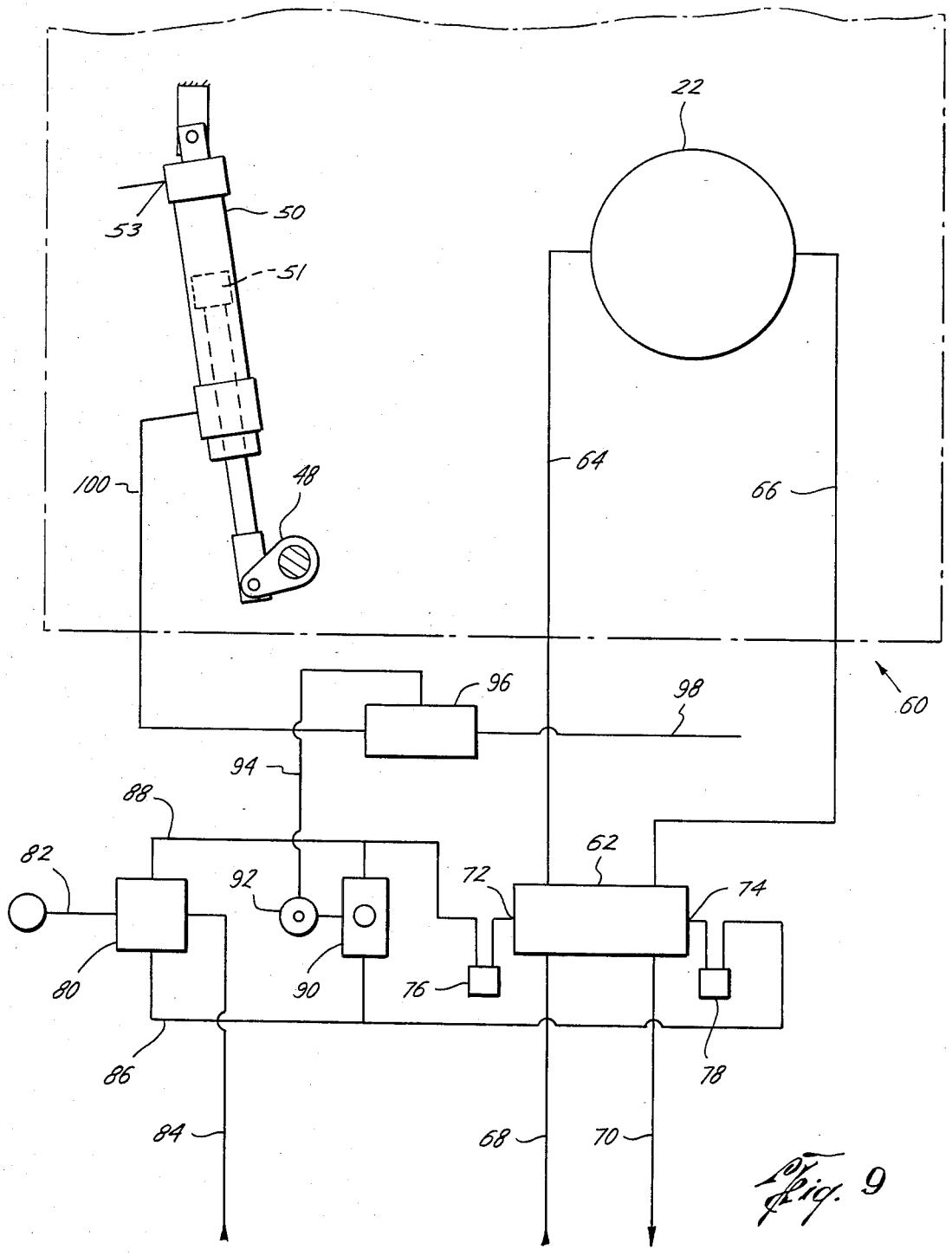
FIG. 9 is a schematic diagram of the control circuit of the present invention.

FIG. 9 is a schematic diagram of the control circuit of the present invention which insures that the movable gear 34 is moved into engagement with the ring gear 20 before the motor 22 is actuated. The motor 22 is preferably air or hydraulic and the actuator 50 may be the piston and cylinder assembly shown in FIGS. 1–5 or may be the diaphragm valve 50*a* shown in FIGS. 6 and 7, but here is shown as the piston and cylinder assembly 50 having a piston 51 and a vent 53. The motor 22 is connected to a four-way valve 62 by lines 64 and 66. A fluid supply line 68 and exhaust line 70 are connected to the valve 62. The valve 62 includes pilot ports 72 and 74 which are connected to flow control devices 76 and 78, respectively.

Valve 80 is a three-way hand operated valve actuated by handle 82 in which the handle may be moved to either first or second position for rotating the motor 22 in forward or reverse directions. The valve 80 includes a fluid inlet line 84 and fluid outlet lines 86 and 88. Moving the handle 82 in one direction will supply fluid through line 86 to pilot port 74 of four-way valve 62 for shifting the valve 62 in a direction permitting supply of fluid in line 68 to pass to line 64, actuates the motor 22 with exhaust fluid passing through lines 66 and 70. However, there is a time delay in actuating motor 22 due to the flow control device 78.

During the time delay prior to actuation of the motor 22, fluid from the control valve 80 flows from line 86 to shuttle valve 90, through a quick release valve 92, and line 94 to apply pressure to a three-way diaphragm valve 96 which receives fluid pressure through line 98. Actuation of valve 96 allows pressure from line 98 to flow through line 100 into the assembly 50 to actuate the piston 51, rotate the bell crank 48, rotate the cam 44, move the shifting arm 32 and rotate movable gear 34 into engagement with the gear 20.

Movement of the manual handle 82 in the opposite direction applies fluid pressure to line 88 to flow control devices 76 and pilot port 72 of the four-way valve 62 for reversing the motor 22. At the same time, fluid pressure from line 88 is applied to shuttle valve 90 for applying fluid pressure to actuate valve 96, apply pressure to line 100 and actuate the actuator 50 as before. However, regardless of whether the handle 82 is actuated to rotate the motor 22 in the forward or reverse direction, the fluid control devices 76 and 78 delay the opening of the four-way valve 62 to permit the actuation of the actuator 50 before valve 62 opens for starting the motor 22. The flow control devices 76 and 78 may be an orifice limiting flow towards valve 62 with a check valve allowing full flow away from valve 62. This insures that the gears 34 and 20 are engaged and locked together before the motor 22 starts.

When the valve 82 returns to the neutral position, pressure is exhausted from actuator 50 through valve 96 and quick exhaust valve 92 and similarly exhaust pressure from either line 86 or 88 to allow valve 62 to shift to the neutral position stopping the motor 22.

The present invention, therefore, is well adapted to carry out the objects and attain the ends and advantages mentioned as well as others inherent therein. While a presently preferred embodiment of the invention is given for the purpose of disclosure, numerous changes in the details or constructron and arrangement or parts, and steps or the process will readily suggest themselves to those skilled in the art and which are encompassed within the spirit of the invention and the scope of the appended claims.

What is claimed is:

1. In a power spinner for rotating a kelly joint having a pipe sub rotatably mounted in a housing, a ring gear on said sub, and a reversible motor mounted on the housing for powering the ring gear and sub in either direction, the improvement comprising, a drive gear connected coaxially to the motor, a shifting arm pivotally mounted coaxially with the axis of the drive gear, a movable gear is positioned in the plane of the ring gear and mounted on the shifting arm for engagement and disengagement with the ring gear, said movable gear connected to and driven by the drive gear and rotatable about the drive gear, a cam engaging the arm for rotating the arm about the axis of the drive gear for laterally moving the movable gear toward and away from the ring gear, said cam including a locking surface for holding the gears together when engaged, and power actuated means connected to the cam for actuating the cam to the locked position.

2. The apparatus of claim 1 including, a bell crank connected to and actuating the cam.

3. The apparatus of claim 1 wherein the power actuated means includes, a piston and cylinder.

4. The apparatus of claim 1 including a control circuit for insuring the movable gear is in engagement with the ring gear before the motor is actuated including, a pilot actuated valve connected to said motor for providing power thereto, a manually actuated control valve connected to said pilot actuated valve and to said power actuated means for supplying power thereto, and time delay means positioned between the control valve and the pilot actuated valve for insuring actuation of the control means prior to the actuation of the motor.

* * * * *